US006939257B2

(12) United States Patent
Tiitola

(10) Patent No.: US 6,939,257 B2
(45) Date of Patent: Sep. 6, 2005

(54) METHOD FOR MANUFACTURING SHAFT OF STICK, AND SHAFT

(75) Inventor: Antti-Jussi Tiitola, Kaivanto (FI)

(73) Assignee: Montreal Sports Oy, Padasjoki (FI)

( * ) Notice: Subject to any disclaimer, the term of this patent is extended or adjusted under 35 U.S.C. 154(b) by 3 days.

(21) Appl. No.: 10/173,812

(22) Filed: Jun. 19, 2002

(65) Prior Publication Data

US 2003/0008734 A1 Jan. 9, 2003

(30) Foreign Application Priority Data

Jun. 28, 2001 (FI) ..... 20011391

(51) Int. Cl.[7] ..... A63B 59/14
(52) U.S. Cl. ..... 473/561
(58) Field of Search ..... 473/560–562

(56) References Cited

U.S. PATENT DOCUMENTS

| | | | | | |
|---|---|---|---|---|---|
| 4,361,325 | A | | 11/1982 | Jansen | |
| 5,217,221 | A | | 6/1993 | Baum | |
| 5,439,215 | A | | 8/1995 | Ratchford | |
| 5,865,696 | A | * | 2/1999 | Calapp et al. | 473/561 |
| 5,879,250 | A | * | 3/1999 | Tahtinen et al. | 473/561 |
| 6,113,508 | A | * | 9/2000 | Locarno et al. | 473/516 |
| 6,206,793 | B1 | * | 3/2001 | Burger | 473/561 |
| 6,241,633 | B1 | * | 6/2001 | Conroy | 473/561 |
| 6,257,997 | B1 | * | 7/2001 | Doble et al. | 473/516 |
| 2002/0037780 | A1 | * | 3/2002 | York et al. | 473/560 |

* cited by examiner

*Primary Examiner*—Mark S. Graham
(74) *Attorney, Agent, or Firm*—Sughrue Mion, PLLC

(57) ABSTRACT

A method for manufacturing a shaft of an ice hockey stick, or the like, and a shaft. The shaft comprises an inner, first body part formed of binding material and reinforcing fibers that cross one another. Onto the first body part there is formed a second, substantially co-axial, body part containing binding material and longitudinal reinforcing fibers. The cross-section of the inner profile of the first body part is oval and the cross-section of the outer profile of the second body part is substantially rectangular, the shaft being thus provided with wall thickness that is greater at the corners than at the sides.

11 Claims, 7 Drawing Sheets

METHOD FOR MANUFACTURING SHAFT OF STICK, AND SHAFT

FIELD OF THE INVENTION

The invention relates to a method for manufacturing a shaft of an ice hockey stick, or the like, the method comprising forming an elongated first body part having an oval cross-sectional shape and containing binding material and reinforcing fibres that cross one another.

The invention further relates to a shaft of an ice hockey stick, or the like, comprising a first body part which is an elongated piece of an oval cross-sectional shape and contains binding material and reinforcing fibres that are arranged to cross one another.

BACKGROUND OF THE INVENTION

The shafts of sticks used in ice hockey, street hockey and other similar games conventionally have a rectangular cross-sectional shape, with rounded corners. The shafts are made of stripes of wood and glass fibre laminate, which is used to provide added strength. In addition to conventional shafts that contain wood, shafts known as composite shafts have been developed, which are substantially entirely made of fibre-reinforced plastic. In comparison with conventional wooden shafts, the advantage of composite shafts is their good weight to rigidity ratio and the fact that their rigidity can be adjusted in a controllable manner by varying the amount, quality and direction of the reinforcing fibres. Known composite shafts are manufactured by winding reinforcing fibres around a mandrel or a lightweight core. Due to the manufacturing process, this kind of shaft is provided with an oval cross-sectional shape. This shape has not, however, gained popularity among players, who prefer conventional sticks that have rectangular shafts. Composite shafts with a rectangular cross-sectional shape cannot be manufactured by winding, because the pressure caused by the wound reinforcing fibres is greater on the corners of the rectangle than on its sides. The binding material therefore tends to move away from the area of the corners, the corners thus forming the thinnest area in the cross-section of the shaft. In a known manufacturing method, a reinforcement fabric is wrapped around a mandrel, after which the blank is pressed and hardened in a mould or an autoclave. Also here the problem is that the tightly wrapped reinforcement fabric presses binding material away from the area of the corners, and the corners become weak. The corners are, however, the most critical area of the shaft, because they are subject to impacts during the game. An impact on the fragile corner may damage this kind of shaft structure relatively easily.

BRIEF DESCRIPTION OF THE INVENTION

It is an object of the present invention to provide a novel and improved shaft of an ice hockey stick, or the like, and a method for manufacturing the same.

A method for manufacturing a shaft of an ice hockey stick, or the like, comprises forming an elongated first body part having an oval cross-sectional shape and containing binding material and reinforcing fibres that cross one another; forming an elongated second body part containing binding material and longitudinal reinforcing fibres, and having an outer profile of a substantially rectangular cross-sectional shape; arranging the second body part around the first body part and substantially co-axially with it; and attaching the first body part and the second body part together to provide a uniform structure.

A shaft of an ice hockey stick, or the like, comprises at least: a first body part which is an elongated piece of an oval cross-sectional shape and contains binding material and reinforcing fibres that are arranged to cross one another: a second body part which is arranged around the first body part and substantially co-axially with it; and in which the outer profile of the second body part is substantially rectangular, having both sides and corners; and in which the second body part contains binding material and reinforcing fibres parallel with the longitudinal direction of the shaft.

Further, a shaft of the invention comprises at least: a first body part which is an elongated piece having an oval cross-sectional shape and containing binding material and reinforcing fibres that are arranged to cross one another; a second body part which contains binding material and reinforcing fibres substantially parallel with the longitudinal direction of the shaft, and which is formed around the first body part; and in which the outer profile of the cross-section of the second body part is substantially rectangular, consisting of four sides and four corners; and in which the combined wall thickness formed by the first body part and the second body part is greater at the corners than the wall thickness of the sides.

Further, a shaft of the invention comprises a body which is an elongated, pipe-like piece formed of binding material and reinforcing fibres; and the cross-section of the inner profile of which body is substantially oval; and the cross-section of the outer profile of which body is substantially rectangular, having four corners and four sides; the wall thickness being greater at the corners than at the sides.

An essential idea of the invention is that the shaft comprises an elongated first body part of a substantially oval cross-sectional shape. Further, onto the first body part there is provided a longitudinal, co-axial second body part the outer profile of which is substantially rectangular. Consequently, the outer surface of the cross-sectional profile of the shaft is also rectangular, preferably with rounded corners, which is the shape preferred by the players. The body parts are both made of a strong, although lightweight, plastic composite consisting of reinforcing fibres and binding material. The first body part comprises reinforcing fibres that cross one another, the first body part thus providing the shaft with excellent durability against shear forces and good torsional rigidity. The outermost body part, i.e. the second body part may comprise reinforcing fibres that are substantially parallel with the longitudinal direction of the shaft and provide the structure with the desired bending stiffness.

An advantage of the shaft of the invention is that the outer surface of its cross-sectional profile is similar in shape as conventional shafts. A further advantage is that the combined wall thickness formed by the oval inner body part and the rectangular outer body part is greater at the corner portions than at the sides. As distinct from prior art composite sticks, this kind of shaft has excellent impact resistance. Despite its solid corners, the shaft structure is light, because there is correspondingly less material in the area of the less critical sides.

An embodiment of the invention is based on the idea that at the corners the combined wall thickness formed by the first body part and the second body part is at least double the wall thickness of the sides.

An essential idea in a further embodiment of the invention is that the relative proportion of longitudinal reinforcing fibres and binding material is essentially constant in the different portions of the cross-section of the second body part.

An essential idea of a still further embodiment of the invention is that the shaft is a hollow, pipe-like structure.

An essential idea of yet another embodiment of the invention is that at least on the corner portions of the shaft profile the outer surface of the second body part is provided with reinforcements made of binding material and a reinforcement fabric. These reinforcements further improve the impact resistance of the corners.

BRIEF DESCRIPTION OF THE DRAWINGS

The invention will be described in greater detail with reference to the following drawings, in which.

For the sake of clarity, the Figures show a simplified view of the invention. Like parts are referred to using like reference numerals.

DETAILED DESCRIPTION OF THE INVENTION

Figure 1:
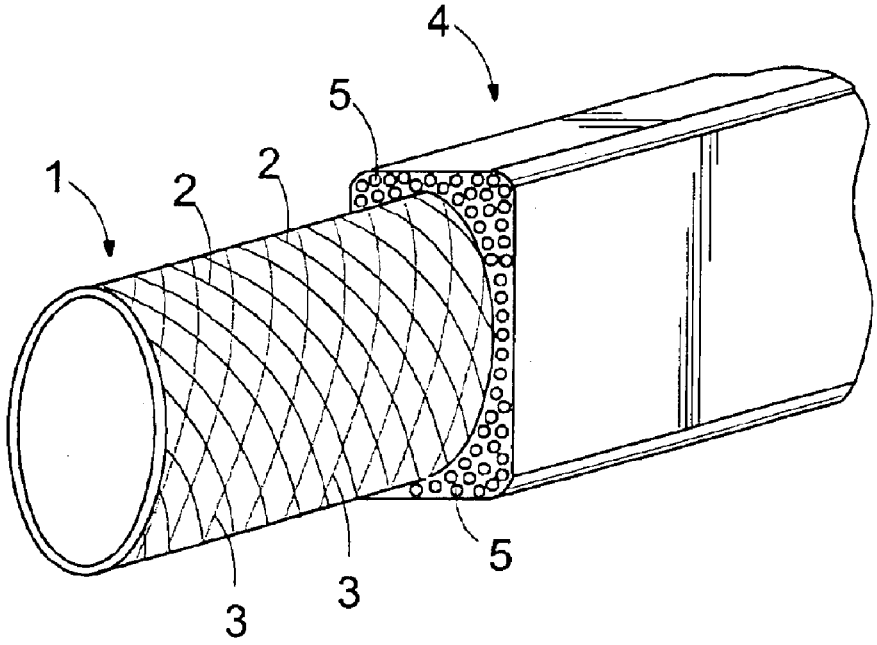
FIG. 1 is a schematic, perspective view of a shaft structure of the invention.

FIG. 1 shows the structure of a shaft of the invention, the structure comprising an innermost first body part 1 of an oval cross-sectional shape. The first body part 1 comprises binding material and reinforcing fibres 2 running at an angle of 30 to 45° in relation to the longitudinal direction of the shaft. Glass fibre or carbon fibre, for example, may be used as reinforcing fibres 2, or two or more different reinforcing fibres can be combined in a suitable manner. The binding material may be a suitable plastic material, such as epoxy resin. In the first body part the reinforcing fibres 2 are arranged to cross one another for example by winding them one on top of the other, in a manner to be described in connection with FIG. 4, to produce at least two layers of crossing fibres. The oval cross-sectional shape and the crossed reinforcing fibres allow to achieve particularly good torsional rigidity and a capability to receive shear forces, both of these being properties that a good ice hockey stick is expected to display. In FIG. 1 the fibres in the lower layer are shown by a dotted line 3. Further, onto the first body part 1 there is provided a coaxial, second body part 4, which comprises binding material and reinforcing fibres 5 parallel with the longitudinal direction of the shaft. The reinforcing fibres 5 may be glass fibres or carbon fibres, for example. These fibres may also be combined in a suitable manner; by increasing the proportion of glass fibres, a more flexible shaft is obtained, whereas by increasing the proportion of carbon fibres, the shaft can be made more rigid. In some special cases it is also possible to use aramid fibres. The binding material may be a suitable plastic material, such as epoxy resin. The first body part 1 and the second body part 4 are elongated shaft parts, their length corresponding substantially to that of the shaft. During the manufacture of the shaft, the first body part 1 and the second body part 4 are joined together to form a uniform entity consisting of layers that cannot be individually detached without breaking the structure.

Figure 2:
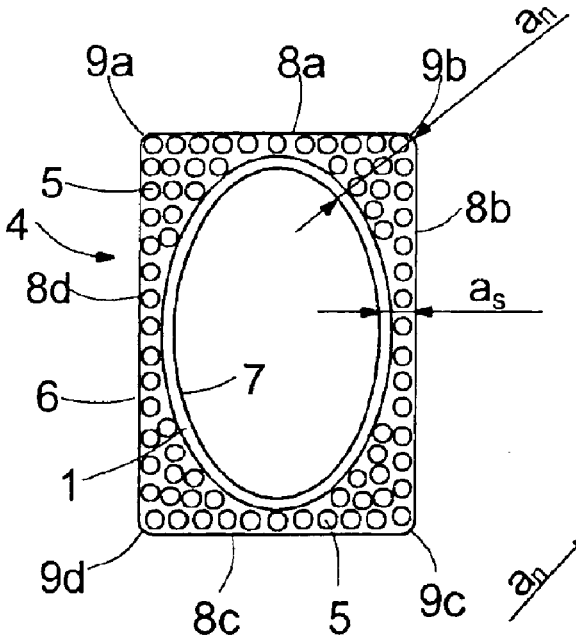
FIG. 2 is a schematic view of a cross-section of a shaft of the invention.

FIG. 2 shows that the outermost body part of the shaft, i.e. the second body part 4, has an outer surface 6 profile which is rectangular, with rounded corners, and which thus corresponds to the shape of a conventional wooden stick that players have found to be good. Further, the shaft structure is a hollow tube, the shaft having an inner surface 7 of an oval cross-sectional shape. The side surfaces 8*a*–8*d* of the profile have a wall thickness $a_s$, which is smaller than wall thickness $a_n$ at the corners 9*a*–9*d*. The wall thickness $a_s$ of the sides 8*a*–8*d* is typically about 1.4–1.5 mm, whereas the wall thickness $a_n$ at the corners 9*a*–9*d* may be about 3–4 mm, i.e. about 2 to 3 times that of the sides 8*a*–8*d*. For the shaft to be lightweight, the size of the its cross-sectional area must be limited. To optimise the weight to rigidity ratio of the shaft, the wall thickness $a_s$ is reduced at the sides 8*a*–8*d*, which are less critical in terms of durability, while at the corners 9*a*–9*d* the wall thickness $a_n$ is increased. The cross-sectional area available for the cross-section of the shaft, and thereby the mass of the shaft, is formed in a manner which is more advantageous than before in view of rigidity and impact resistance.

FIG. 2 further shows that it is possible to arrange the longitudinal reinforcing fibres 5 such that they are distributed as evenly as possible on the cross-sectional surface of the second body part 4. The relative proportion of the reinforcing fibres 5 and the binding material is substantially constant at the different portions of the cross-section. The corners 9*a*–9*d* thus also comprise longitudinal reinforcing fibres 5, all the way to their outer portion. Since the reinforcing fibres at the corners 9*a*–9*d* are at a distance as long as possible from the centre axis of the shaft, their impact on the rigidity of the shaft is clearly greater than that of the reinforcements fibres at the side portions 8*a*–8*d*, which are at a clearly shorter distance from the centre axis. All in all, the shaft properties can be adjusted in a most diversified manner by selecting a suitable binding material, a suitable number of reinforcing fibres, and a suitable carbon to glass fibre ratio for the structure. Further, the properties can be influenced by the placing of the reinforcing fibres, i.e. the angular position of the reinforcing fibres in the first body part, and by placing specific reinforcing fibres in the cross-sectional profile of the second body part either closer to the centre axis of the shaft, or further away from it.

Figure 3:
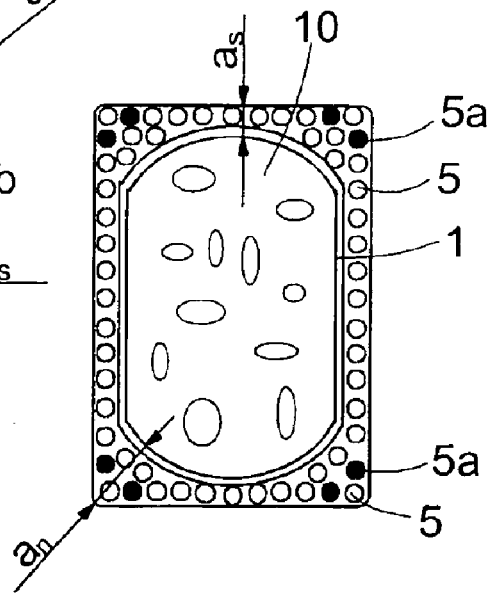
FIG. 3 is a schematic view of a second cross-section of a shaft of the invention.

FIG. 3 shows a shaft structure which otherwise corresponds to the one shown in FIG. 2, except that in this case there is a space 10, left inside the first body part 1, which is filled with a suitable lightweight core, such as an expanded plastic material. Further, FIG. 3 shows a shaded area, which represents reinforcing fibres 5*a* made of carbon fibre and running substantially parallel with the longitudinal direction of the second body part 4. Reference numeral 5 here denotes reinforcing fibres made of glass fibres.

Further study of FIGS. 2 and 3 shows cross-sectional shapes of the first body part 1 that are slightly different, although both are essentially oval. In FIG. 2 the cross-sectional shape of the first body part 1 is elliptic, whereas in FIG. 3 the long sides of the cross-section are straight while the short ones are curved.

In the following, some manufacturing phases of a shaft of the invention will be discussed with reference to FIGS. 4 to 9. It is to be noted that in addition to the methods described in the present application, it is in principle possible to use any other manufacturing method suitable for producing the shaft of the invention.

Figure 4:
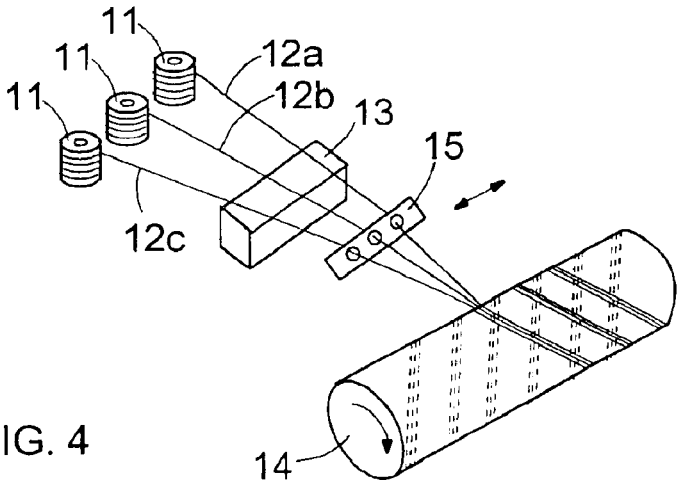
FIG. 4 is a schematic view of a method for manufacturing a first body part.
Figure 14:
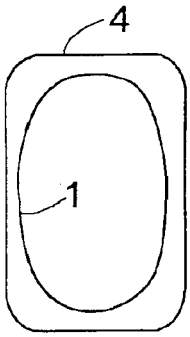
FIGS. 14 to 17 are schematic end views of shaft profiles.
Figure 15:
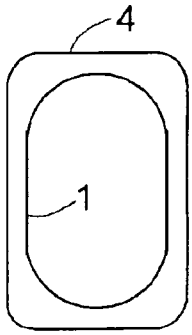
Figure 16:
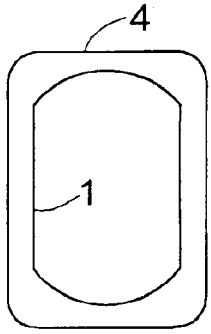
Figure 17:
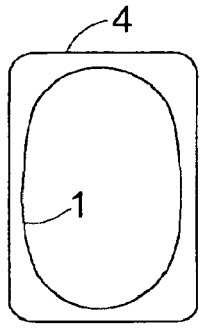

FIG. 4 shows the principle of the winding used in the manufacture of the first body part. Reinforcing fibres 12*a*–12*c* are unwound from one or more reels 11 into a basin 13, where they are moistened with binding material. The reels 11 may be provided with glass and/or carbon fibre, as needed, for the winding. Alternatively, reinforcing fibres impregnated in advance with binding material, such as epoxy resin, may be used. In that case the reinforcing fibres are not guided into a basin, but directly onto the surface of a mould 14 rotated about its axis. The reinforcing fibres 12*a*–12*c* are guided at a suitable angle from a winding controller 15 to the outer surface of the rotating mould 14. The mould 14 and/or the winding controller 15 are moved relative to each other to adjust the length of the wound portion. The winding takes place in layers, i.e. the fibres are first wound from a first end of the mould to its second end and then in the reverse direction, so that the reinforcing fibres in the different layers are arranged crosswise in relation to one another. In FIG. 4 the reinforcing fibres in the lower layer are shown by a dotted line. The mould 14 may be what is known as a mandrel, its oval cross-sectional defining the shape of the piece to be obtained by the winding. When a sufficient number of layers has been wound, the binding material is left to harden by itself, or it is hardened in an furnace. Alternatively, the winding may be carried out onto a lightweight core, which is left inside the wound layer. In that case, the cross-section of the shaft is like the one shown in FIG. 3.

As an alternative for winding, it is possible to use a braided or otherwise pre-manufactured reinforcement sock which is placed onto the mandrel or lightweight core, treated with binding material, and hardened. Further, the first body part 1 may be manufactured by wrapping a fabric containing crossing reinforcing fibres around the mandrel or lightweight core.

Figure 5:
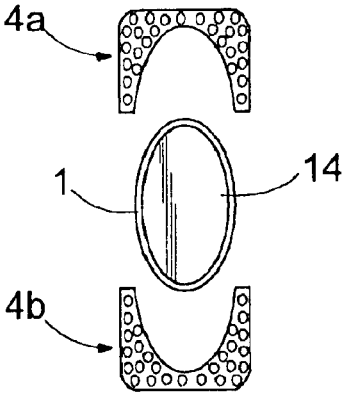
FIGS. 5 and 6 are schematic views of a method for assembling a shaft of the invention.
Figure 6:
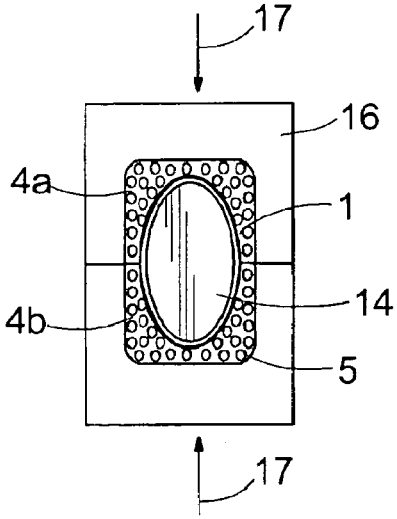

FIG. 5 shows a method for manufacturing the second body part 4. Bundles of reinforcing fibres impregnated in the binding material are made into two symmetrical halves 4*a* and 4*b*. As shown in the simplified FIG. 6, the halves 4*a*, 4*b* are arranged onto the wound first body part 1 that is on the mandrel 14, and the entity is then arranged into a mould 16. The mould 16 is closed and the halves 4*a*, 4*b* of the second body part are pressed against the first body part 1, as illustrated by arrows 17 in the Figure. The structure is then hardened by heating. When the shaft is hard, the mould 16 is opened and the mandrel 14 is pulled out of the shaft.

Figure 7:
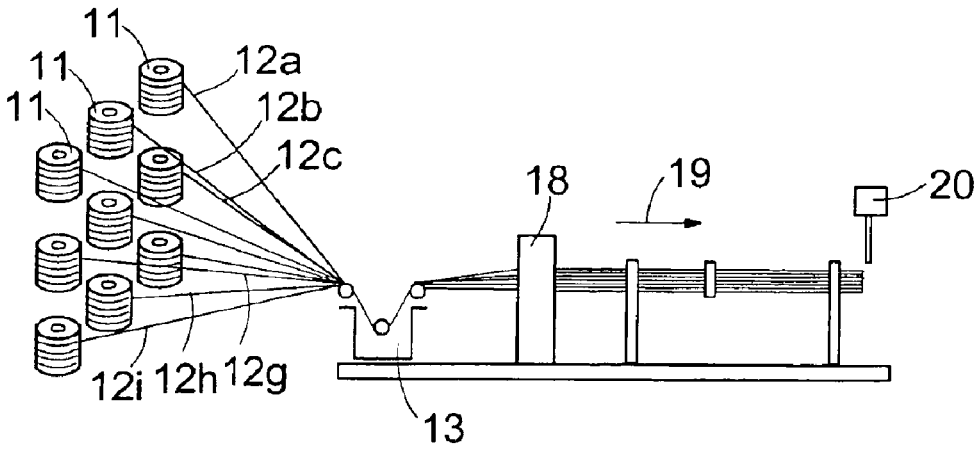
FIG. 7 is a schematic view of a method for manufacturing a second body part.

FIG. 7 shows another feasible manufacturing method in which the halves 4*a*, 4*b* of the second body part are manufactured by pultrusion. In pultrusion, a necessary number of reinforcing fibres 12*a*–12*i* are pulled from the reels 11 through a basin 13 containing binding material and further into a mould 18. The mould 18 shapes the reinforcing fibres into the desired cross-sectional shape. The mould 18 can be heated to harden the binding material, and after the shaping the product thus has a specific, solid shape. In pultrusion, the product is pulled into the direction shown by arrow 19, and when a piece of a desired length has been formed, the product is cut using a cutting means 20. The process in question may be a continuous one. The halves 4*a*, 4*b* of the second body part thus formed may be glued, for example, onto the first body part manufactured by winding.

Figure 8:
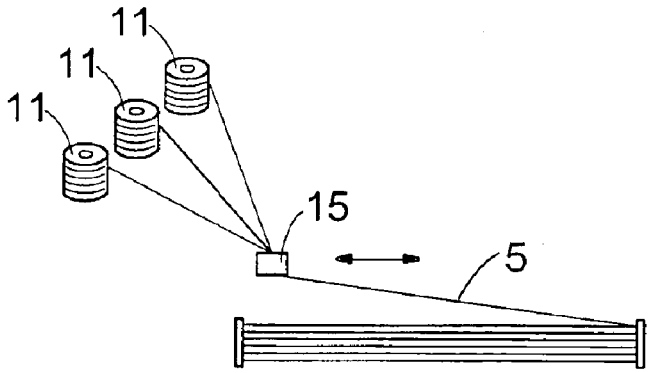
FIG. 8 is a schematic view of a second method for manufacturing a second body part.
Figure 9:
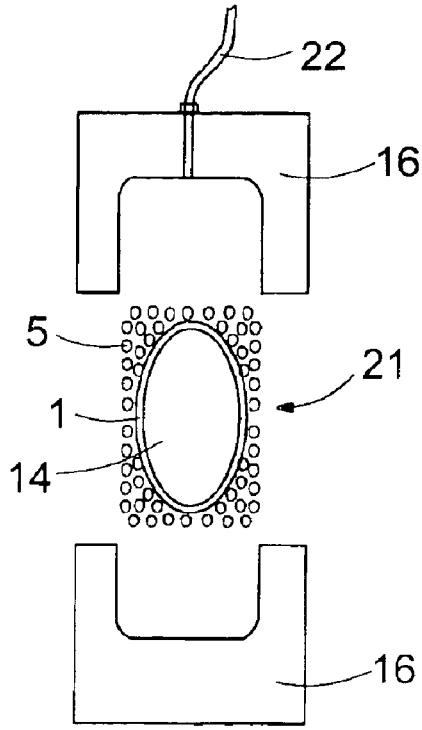
FIG. 9 is a schematic view of a method for assembling a shaft.

FIG. 8 shows a solution in which the reinforcing fibres 5 in the second body part 4 are arranged by means of axial braiding onto the wound first body part 1 serving as a reinforcement blank. The first body part 1 and the reinforcing fibres of the second reinforcement part 4 thus form a single integrated reinforcement blank called a pre-form 21, which is schematically shown in FIG. 9. The pre-form 21 is placed into the mould 16, which is then closed and sealed. Next, binding material, usually epoxy resin, is injected into the mould through a duct 22. Finally, the entity is heated and the mandrel 14 is removed from within the shaft. It is also possible to produce the pre-form by using pultrusion to form the reinforcing fibres of the second body part 4 onto the first body part 1 and to bind the pre-form into an integral whole by means of heat-activated binding material.

Figure 10:
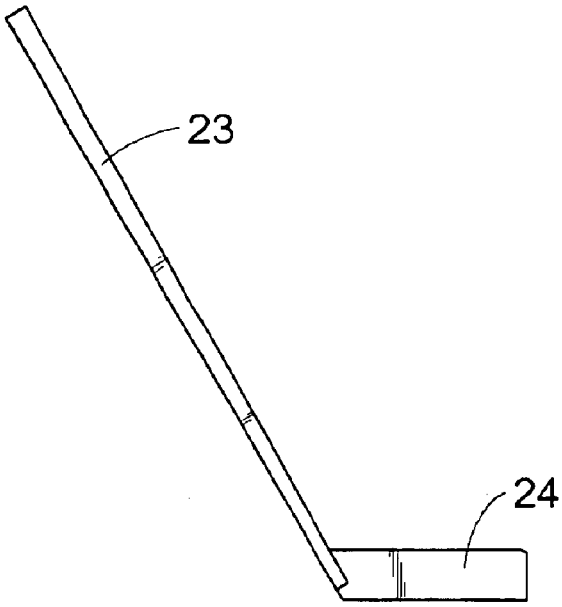
FIG. 10 is a schematic side view of a stick construction.

FIG. 10 is a side view of an ice hockey stick. This solution comprises a shaft 23 of the invention which is arranged to taper to some extent at its lower end to allow a blade 24 to be attached.

Figure 11:
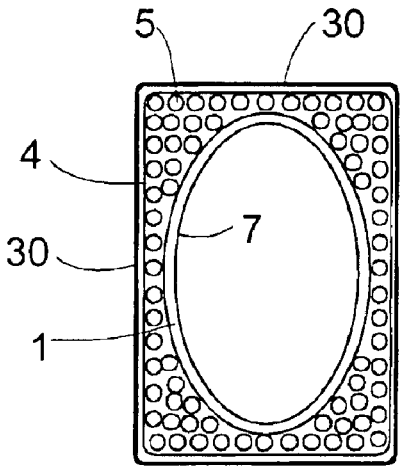
FIGS. 11 and 12 are schematic views of possible cross-sections of a shaft of the invention.
Figure 12:
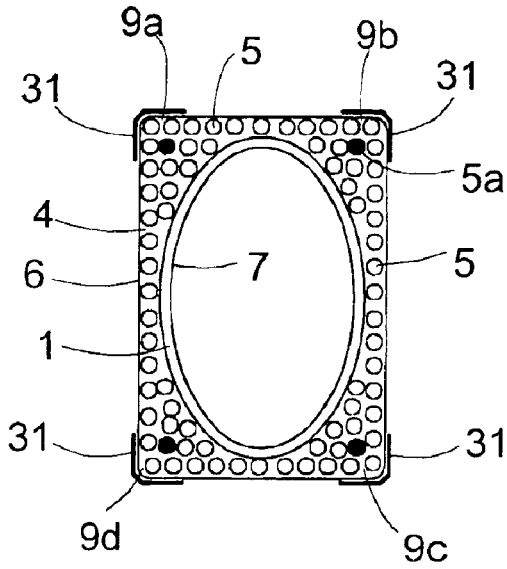

As shown in FIG. 11, the second body part 4 may be provided with at least one layer of reinforcing fabric arranged substantially entirely onto the body part, the layer and the binding material forming a reinforcement 30. The reinforcement fabric may be for example a pre-manufactured, sock-like fabric and it may contain aramid fibres, which have good impact resistance. This kind of reinforcement 30 protects the longitudinal reinforcing fibres 5 against blows. In addition, the reinforcement 30 improves the transverse strength of the shaft. As shown in FIG. 12, a solution is possible where outer reinforcements 31 are arranged only at the corners 9*a*–9*d* to enhance the impact resistance of the corners. The reinforcements 30, 31 may be conveniently placed into the shaft structure in connection with pultrusion, for example. Alternatively, the reinforcement fabrics of the reinforcements 30, 31 may be arranged into the mould halves at the same time with the other reinforcement blanks, before the binding material is injected.

Figure 13:
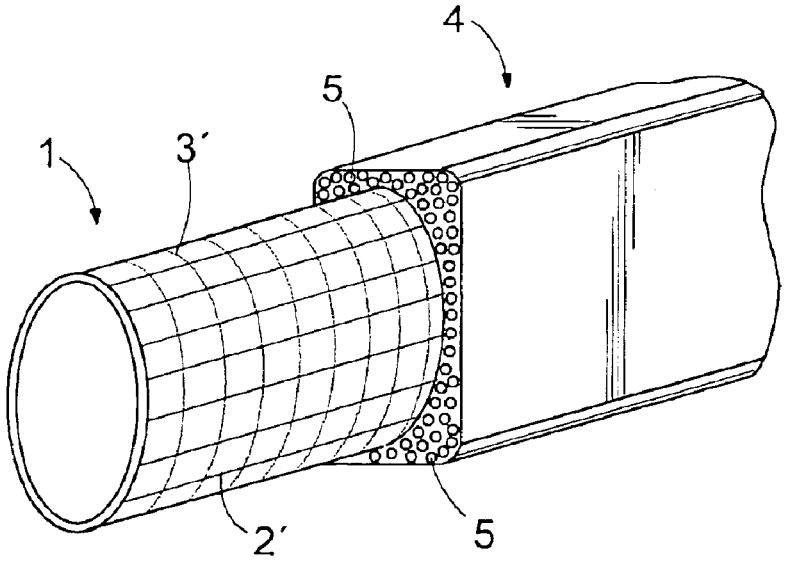
FIG. 13 is another schematic perspective view of a structure of a shaft of the invention.

In the structure shown in FIG. 13, the first body part 1 comprises longitudinal reinforcing fibres 2' and transverse reinforcing fibres 3'. The reinforcing fibres in the first body part 1 may constitute a suitably formed sock, which is drawn in a longitudinal direction onto the mandrel or, alternatively, the reinforcing fibres may be formed into a fabric that is wrapped around the mandrel.

FIGS. 14 to 17 illustrate some further shaft profile shapes which show the first body part 1 having a substantially oval cross-section and, further, the second body part 4 having an outer profile of a substantially rectangular cross-section.

One aim may be to arrange the relative proportion of longitudinal reinforcing fibres 5 and binding material to be substantially constant at the different portions of the cross-section of the second body part 4.

Figure 18:
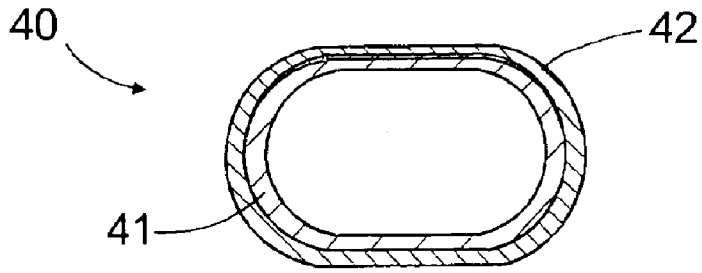
FIGS. 18 to 20 are schematic views of another alternative method for manufacturing a shaft.
Figure 19:
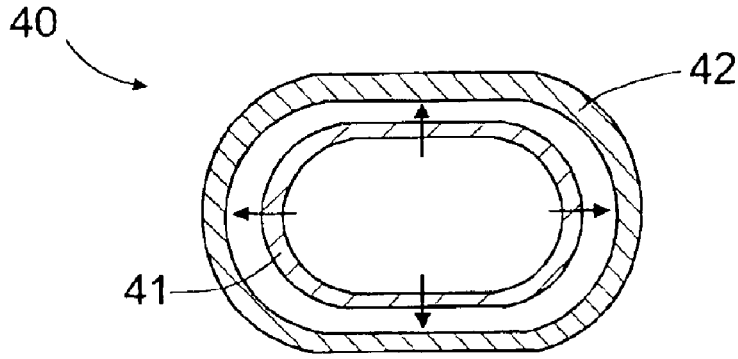
Figure 20:
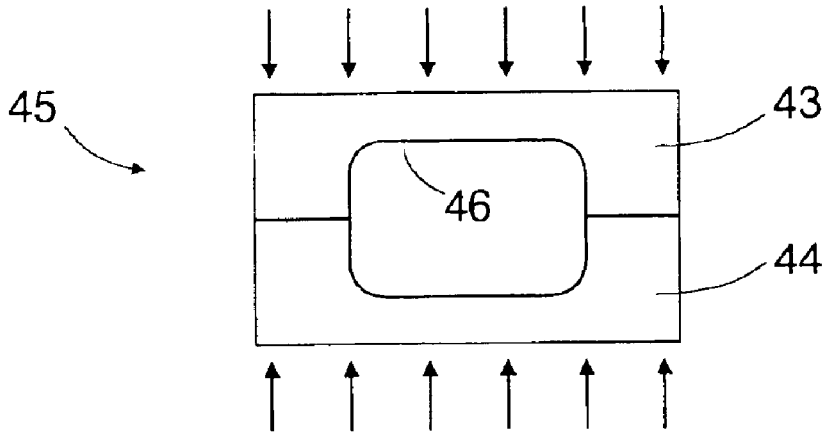

FIGS. 18 to 20 further show a method for manufacturing a shaft of the invention. The first body part 1 of the shaft can be wound around an expansive mandrel 40. The expansive mandrel comprises a hollow, substantially oval rigid body 41, such as a metal tube, onto which there is arranged a radially stretching hose 42. The hose 42 may be made of suitable rubber or elastomere. The hose 42 is sealed at both ends such that suitable gaseous or liquid medium can be led between the hose 42 and the body 41 of the mandrel through the hollow inner space of the mandrel, for example. As the medium penetrates between the body 41 and the hose 42, the hose 42 expands and the cross-section of the mandrel 40 increases, as shown in FIG. 19. Next, at least two fibre layers of continuous reinforcing fibres are wound around this substantially oval, expansive mandrel 40. The reinforcing fibres in the superimposed layers are crosswise in relation to one another. The reinforcing fibres of an individual fibre layer may be arranged at an angle of 30–60° in relation to the longitudinal axis of the mandrel 40. In addition to the two or more crossing reinforcement layers, it is possible to wind at least one reinforcement layer in which the reinforcing fibres are at an angle of almost 90° in relation to the longitudinal axis of the mandrel 40. The fibres to be wound may be fibres pre-impregnated with the binding material, known as pre-preg fibres, or they may be impregnated with the binding material in connection with the winding.

The second body part of the shaft may be manufactured in various ways. One method is to use the pultrusion, which means that the expansive mandrel 40 and the first body part 1 wound around it are taken through a nozzle, the longitudinal reinforcing fibres of the second body part being guided onto the first body part in a manner determined by the nozzle opening. The nozzle opening is rectangular and therefore longitudinal reinforcing fibres are guided in the corner areas of the shaft blank, thereby allowing the desired outer profile and wall thickness to be obtained in the corners. The longitudinal fibres may be pre-impregnated pre-preg fibres, or the fibres may be impregnated with the binding material in connection with the pultrusion. After the pultrusion the shaft blank may be provided with a reinforcement sock made of reinforcing fibres and pulled onto the blank, or a reinforcement fabric forming the outermost surface of the shaft may be wrapped around the blank. The shaft blank is then placed between the mould halves 43 and 44 shown in FIG. 20. The mould 45 is closed and the expansive mandrel 40 is pressurized by compressed air or some other suitable medium. The expansive mandrel 40 presses the blank against the inner walls 46 of the mould 45, the shaft being thereby provided with a substantially rectangular outer profile defined by the mould halves 43 and 44. The mould 45 is heated, whereby the binding material hardens and binds the reinforcing fibres together to form a uniform composite structure.

Figure 21:
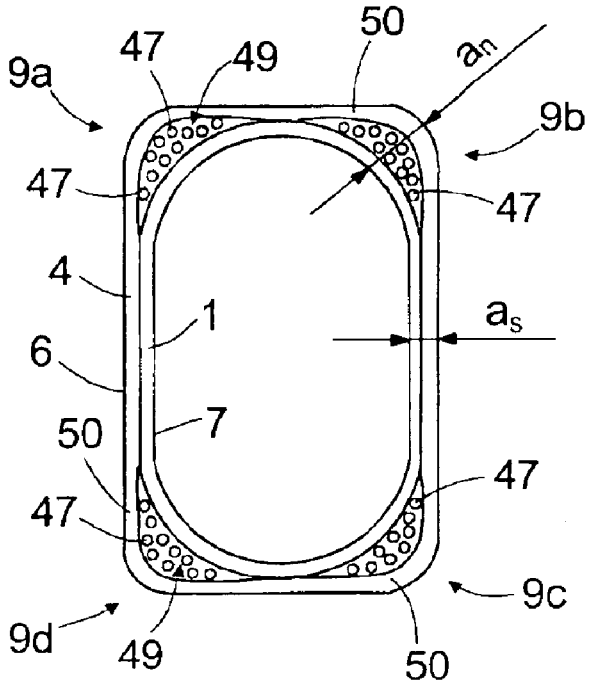
FIG. 21 is a schematic cross-sectional view of a shaft provided with lightened portions at the corners.

In the above-described method some of the longitudinal fibres in the corner areas of the second body part may be replaced by lightened fibre bundles in which hollow microballs made of plastic or glass are attached to the reinforcing fibres. As shown in FIG. 21, the microballs 47, binding material and reinforcing fibres together form a lightweight portion 49 in the area terial and reinforcing fibres together form a lightweight portion 49 in the area of the corners 9*a*–9*d*, the portion being surrounded by a solid cover 50. This kind of structure allows the weight of the shaft to be reduced without essentially reducing the strength of the shaft.

Figure 22:
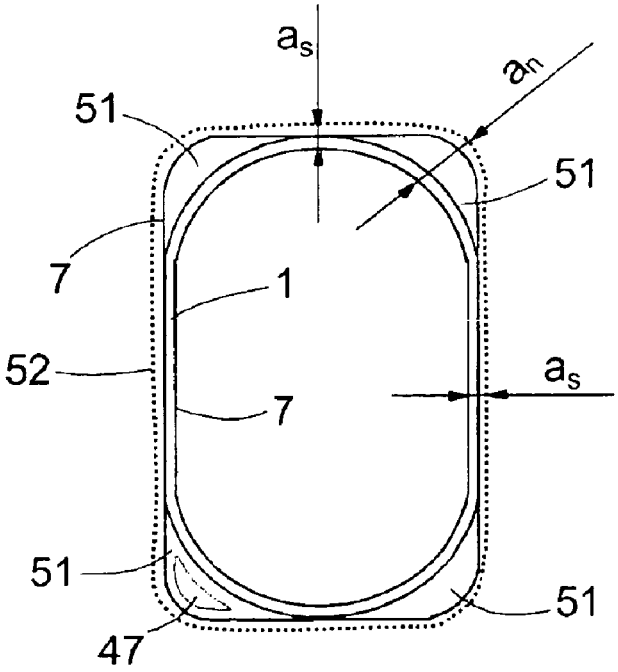
FIG. 22 is a schematic cross-sectional view of a shaft provided with a rectangular outer profile obtained by means of four corner pieces.

FIG. 22 shows a shaft in which the second body part comprises corner pieces 51, which are arranged on the outer surface of the first body part 1 so that a substantially rectangular outer profile 7 is obtained for the cross-section of the shaft. The corner pieces 51 can be manufactured in a separate phase by means of extrusion, for example, and they may be made of a suitable impact-resistant thermoplastic plastic material, such as ABS plastic or thermoplastic polyurethane. The corner pieces 51 may comprise one or more longitudinal hollow spaces 47 which reduce the weight of the corner pieces 51, but do not essential impair their strength. Further, the two corner pieces 51 may be joined into a single integrated piece, the corner piece 51 thus forming two corners 9*a*, 9*b*; 9*c*, 9*d* to the shaft. The shaft may be surrounded with an outermost portion made of reinforcing fibres and binding material and serving as a surface layer 52. In the above-described method the first body part 1 may be formed around the expansive mandrel. When the corner pieces 51 have been arranged in place, a sock made of reinforcing fibres may be pulled onto the blank, or it may wrapped into a surface fabric. The blank is then placed into the mould 45 where it is pressed against the inner surface 46 of the mould 45 by impact of the expansive mandrel 40. The blank is hardened by heating it in the mould 45.

The drawings and the related specification are only intended to illustrate the inventive idea. The details of the invention may vary within the scope of the claims.

What is claimed is:

1. A shaft of an ice hockey stick, comprising at least:

a first composite body part which is an elongated piece of an oval cross-sectional shape and contains binding material and reinforcing fibres that are arranged to cross one another:

a second composite body part which is arranged around the first composite body part and substantially co-axially with it;

and in which the outer profile of the second composite body part is substantially rectangular, having sides and corners;

and in which the second composite body part contains binding material and reinforcing fibres running substantially parallel with the longitudinal direction of the shaft, said reinforcing fibres of said second composite body part including carbon fibres located substantially in said corners of said second composite body part and glass fibres located substantially in areas other than said corners.

2. A shaft of claim 1, wherein the relative proportion of reinforcing fibres and binding material is arranged to be substantially constant in the cross-section of the second composite body part.

3. A shaft of claim 1, wherein the combined wall thickness formed by the first composite body part and the second composite body part provides a corner thickness that is at least double the corresponding thickness at the sides.

4. A shaft of claim 1, wherein the shaft is a hollow, pipe-like structure.

5. A shaft of claim 1, wherein the reinforcing fibres in the first composite body part are arranged at an angle of 30–45° in relation to the longitudinal direction of the shaft.

6. A shaft of claim 1, wherein the first composite body part contains longitudinal reinforcing fibres and crosswise reinforcing fibres.

7. A shaft of claim 1, wherein at least the portions at the corners of the shaft are provided with reinforcements arranged as the outermost layer of the shaft, the reinforcements containing reinforcing fibres and binding material.

8. A shaft of claim 7, wherein at least the portions at the corners of the shaft are provided with reinforcements arranged as the outermost layer of the shaft, the reinforcements containing primarily reinforcing aramid fibres and binding material.

9. The shaft of claim 1, wherein the reinforcing fibres of the second composite body part are placed either closer, or further away from, the center axis of the shaft in relation to the second composite body part.

10. A shaft of an ice hockey stick, the shaft comprising at least:

a first composite body part which is an elongated piece having an oval cross-sectional shape and containing binding material and reinforcing fibres that are arranged to cross one another;

a second composite body part which is formed around the first composite body part, and in which the outer profile of the cross-section of the second composite body part is substantially rectangular, consisting of four sides and four corners, said second composite body part containing binding material and reinforcing fibres running substantially parallel with the longitudinal direction of the shaft, said reinforcing fibres of said second composite body part including carbon fibres located substantially in said corners of said second composite body part and glass fibres located substantially in areas other than said corners;

and in which the combined wall thickness formed by the first composite body part and the second composite body part is greater at the corners than the wall thickness of the sides.

11. A shaft of claim 10, wherein the combined wall thickness of the first composite body part and the second composite body part is at least double at the corners, compared with the corresponding wall thickness at the sides.

* * * * *